US010657789B2

(12) United States Patent
Loeb et al.

(10) Patent No.: US 10,657,789 B2
(45) Date of Patent: May 19, 2020

(54) ALERT SENSING DEVICE AND SYSTEM

(71) Applicants: Jack Loeb, Fisher Island, FL (US); Ron Blum, Roanoke, VA (US)

(72) Inventors: Jack Loeb, Fisher Island, FL (US); Ron Blum, Roanoke, VA (US)

( * ) Notice: Subject to any disclaimer, the term of this patent is extended or adjusted under 35 U.S.C. 154(b) by 0 days.

(21) Appl. No.: 15/810,869

(22) Filed: Nov. 13, 2017

(65) Prior Publication Data

US 2019/0147726 A1 May 16, 2019

(51) Int. Cl.

| | |
|---|---|
| ***G08B 29/18*** | (2006.01) |
| ***G08B 21/18*** | (2006.01) |
| ***G08B 25/01*** | (2006.01) |
| ***G08B 29/12*** | (2006.01) |

(52) U.S. Cl.

CPC ..... *G08B 21/182* (2013.01); *G08B 25/016* (2013.01); *G08B 29/12* (2013.01); *G08B 29/188* (2013.01)

(58) Field of Classification Search

CPC .... G08B 21/182; G08B 29/188; G08B 29/12; G08B 25/016; G08B 29/185; G08B 13/22; G08B 13/16; G08B 25/008

See application file for complete search history.

(56) References Cited

U.S. PATENT DOCUMENTS

| | | | | |
|---|---|---|---|---|
| 5,831,528 A | | 11/1998 | Cecic et al. | |
| 5,917,410 A | | 6/1999 | Cecic et al. | |
| 6,114,955 A | * | 9/2000 | Brunius | H04B 17/20 340/286.02 |
| 6,236,313 B1 | | 5/2001 | Eskildsen et al. | |
| 9,349,269 B2 | | 5/2016 | Zhevelev et al. | |
| 2006/0116837 A1 | * | 6/2006 | Hager | G01C 25/00 702/95 |
| 2008/0165001 A1 | * | 7/2008 | Drake | G08B 29/24 340/550 |
| 2008/0211668 A1 | * | 9/2008 | Dixon | B65D 90/00 340/541 |
| 2015/0254950 A1 | * | 9/2015 | Patterson | G08B 13/00 340/541 |
| 2016/0138824 A1 | * | 5/2016 | Patel | F24F 11/0034 700/276 |
| 2016/0189496 A1 | * | 6/2016 | Modi | G08B 13/08 340/545.2 |
| 2016/0189531 A1 | * | 6/2016 | Modi | G08B 29/185 340/506 |

OTHER PUBLICATIONS

Co-Pending International Application No. PCT/US2018/60807 filed Nov. 13, 2018, Search Report and Written Opinion of the International Searching Authority, dated Jan. 4, 2019, 11 pages.

* cited by examiner

*Primary Examiner* — An T Nguyen
(74) *Attorney, Agent, or Firm* — Woods Rogers PLC; Nathan A. Evans

(57) ABSTRACT

The invention disclosed herein is that of an alert system having a sensing device, whereby the sensing device is affixed directly or indirectly to a transparent or translucent covering or surface, whereby the sensing device is affixed directly or indirectly to the outside surface of such covering that is exposed to the outdoor environment, and whereby the sensing device can be connected to a remote electronic device. The alert system is, in a preferred embodiment, meant to issue an alert or alarm if a person inside a premises breaks a window or other glass or plastic surface to gain access from the indoor environment to the outdoor environment.

13 Claims, 10 Drawing Sheets

ALERT SENSING DEVICE AND SYSTEM

BACKGROUND

Field of the Invention

On Oct. 1, 2017, the worst mass killing in recent US history occurred at an event venue adjacent to the Mandalay Bay Hotel in Las Vegas, Nev. The carnage occurred when a gunman broke out windows with a hammer in two rooms located on the $32^{nd}$ floor and proceeded to shoot innocent individuals attending a concert below. While active shooting from numerous weapons firing several hundred rounds of ammunition lasted only 10 minutes or so, every less second or minute would have saved numerous lives. Presently there are literally millions of office buildings, hotels, condos and other buildings that have window or door locations capable of being broken out or removed by a terrorist or demented individual. There is a need to sense for a broken glass window or door and immediately notify a central security station. If this would have existed at the Mandalay Bay Hotel, the hotel security and/or the police would have immediately been alerted to the location of the shooter.

Description of Related Art

Sensing device alarm systems exist in the prior art. However, the prior art systems designed to protect a premises, including doors and windows on a premises, were to protect the premises from somebody breaking into the premises from the outside (e.g., the external environment). A need has arisen to alert authorities or occupants of a premises to a person or persons inside the premises breaking a window or similar structure to gain access to the outside external environment; for example, a gunman breaking a window to attack people outside the building or structure. Premises includes but is not limited to, and by way of example only, a house, apartment, condominium, townhouse, hotel, motel, public building, office building, or other building structure.

The prior art is not specifically attuned to this specific purpose. Moreover, the bulk of the prior art is not only designed for, and therefore limited to, a person breaking into a premises, such a burglar, but it is also limited in terms of its teaching of alarms that trigger in response to a point of entry, such as a door or window, being forced open, or a window being broken. However, the prior art is focused on a sensor located on the interior side of a single window or door. In addition, such a sensor is largely isolated from the extreme sounds and vibrations caused by the outside environment, such as by way of example only, wind, thunderstorms, hail and sonic booms.

Several techniques are known in the art. The most prevalent technique triggers an alarm if a magnetic seal is broken. For example, magnetic contact sensor alarms are based on magnetic balance between a permanent magnet and a cooperating electrically activated magnet. One magnet may be placed on a door frame while the other magnet is placed on the door, in such proximity that a threshold attraction is achieved. Once this attraction goes below the treshhold or is fully broken, an alarm is triggered.

U.S. Pat. No. 6,989,746 teaches an alarm chip for "giving warning of burglary or undesired entry into buildings. Similarly, U.S. Pat. No. 7,187,280 states "[a]larm systems are generally used to secure an area from unwanted intrusion." The particular alarm systems in those patents utilize vibrational techniques to sense intruders coming from the outside in, which may not be sufficient to detect, for example, a gunman poking a small hole in a window or other dwelling covering or surface in order to insert a gun muzzle and target people outside the structure. Also the prior art does not teach how to prevent or reduce false alarms caused by a sensor being exposed to the outdoor environment. The nuances of detecting and eliminating such a complex threat, by way of example, are what the invention herein is able to accomplish.

SUMMARY

The invention disclosed herein includes an alert system having at least one or more sensing devices, whereby in embodiments the sensing device is affixed directly or indirectly to a transparent or translucent covering, such as a window, whereby in embodiments the sensing device is affixed directly or indirectly to the outside surface of such object that is exposed to the outdoor environment, and whereby the sensing device can be connected to a computer device. In certain other embodiments, the sensing device(s) can be affixed to the outside side of the building or frame that houses or supports a transparent or translucent covering. In most, but not all cases, when multiple sensing devices are utilized, the plurality of sensing devices are utilized to determine when an alert is triggered if such an alert is a false alert or a real alert. In one aspect, the alert system comprises a plurality of distance separated sensing devices, whereby the plurality of distance separated sensing devices, which are located external to the indoor environment, are on or near an outdoor side of a plurality of distance separated transparent or translucent coverings or surfaces which are exposed to the outdoor environment and whereby the alert system compares the status of a multiple number of the plurality of distance separated sensing devices to determine if an alert is a real alert or that of a false alert.

The alert system as taught herein can comprise a plurality of distance separated sensing devices. A certain number of the plurality of distance separated sensing devices are located on the outdoor side of a plurality of distance separated transparent or translucent coverings which are exposed to the outdoor environment. The alert system compares the status of a multiple number of the the plurality of distance separated sensing devices to determine if the alert is a real alert or that of a false alert. In certain embodiments, all of the plurality of distance separated sensing devices are located on the outdoor side of a plurality of distance separated transparent or translucent coverings. In other embodiments, most (but not all) of the plurality of distance separated sensing devices are located on the outdoor side of a plurality of distance separated transparent or translucent coverings. In still other embodiments, some (but not most) of the plurality of distance separated sensing devices are located on the outdoor side of a plurality of distance separated transparent or translucent coverings.

Included in embodiments of the invention are methods for using such alert systems to detect physical disturbances. The transparent or translucent covering can be one of or part of glass or plastic window wall(s), fixed or movable plate glass or plastic panel(s), sliding glass or plastic door(s), partial or full glass or plastic ceiling(s) and/or floor(s), window(s), window pane(s), skylight(s) or door(s). The sensing device comprises at least one sensor. The sensor can be one or more of an accelerometer, gyroscope, motion sensor, geo-location sensor, temperature sensor, UV sensor, radiation sensor, acoustic sensor, IR sensor, vibration sensor, gas sensor, inert gas sensor, argon gas sensor, krypton gas sensor, xenon gas sensor, and/or pressure sensor. The sensing device may comprise a controller. The sensing device may comprise or be operationally in communication with a power source, such as a solar cell, a battery, a rechargeable battery, a wired connection to a source of electricity, or any source of power to the device. The sensing device may comprise a transceiver. The sensing device may comprise a receiver. The sensing device may comprise a transmitter. The sensing device may also comprise storage capacity in a memory unit, such as RAM or flash memory.

Embodiments of the invention also include a computer readable medium comprising one or more computer files comprising a set of computer-executable instructions for performing one or more of the calculations, steps, processes and operations described and/or depicted herein. In exemplary embodiments, the files may be stored contiguously or non-contiguously on the computer-readable medium. Embodiments may include a computer program product comprising the computer files, either in the form of the computer-readable medium comprising the computer files and, optionally, made available to a consumer through packaging, or alternatively made available to a consumer through electronic distribution. As used in the context of this specification, a "computer-readable medium" is a non-transitory computer-readable medium and includes any kind of computer memory such as floppy disks, conventional hard disks, CD-ROM, Flash ROM, non-volatile ROM, electrically erasable programmable read-only memory (EEPROM), and RAM. In exemplary embodiments, the computer readable medium has a set of instructions stored thereon which, when executed by a processor, cause the processor to trigger an alarm or distinguish false positives, based on data stored in the electronic database or memory described herein. The processor may implement this process through any of the procedures discussed in this disclosure or through any equivalent procedure.

In other embodiments of the invention, files comprising the set of computer-executable instructions may be stored in computer-readable memory on a single computer or distributed across multiple computers. A skilled artisan will further appreciate, in light of this disclosure, how the invention can be implemented, in addition to software, using hardware or firmware. As such, as used herein, the operations of the invention can be implemented in a system comprising any combination of software, hardware, or firmware.

Embodiments of this disclosure include one or more computers or devices loaded with a set of the computer-executable instructions described herein. The computers or devices may be a general purpose computer, a special-purpose computer, or other programmable data processing apparatus to produce a particular machine, such that the one or more computers or devices are instructed and configured to carry out the calculations, processes, steps, operations, algorithms, statistical methods, formulas, or computational routines of this disclosure. The computer or device performing the specified calculations, processes, steps, operations, algorithms, statistical methods, formulas, or computational routines of this disclosure may comprise at least one processing element such as a central processing unit (i.e. processor) and a form of computer-readable memory which may include random-access memory (RAM) or read-only memory (ROM). The computer-executable instructions can be embedded in computer hardware or stored in the computer-readable memory such that the computer or device may be directed to perform one or more of the calculations, steps, processes and operations depicted and/or described herein.

Additional embodiments of this disclosure comprise a computer system for carrying out the computer-implemented method of this disclosure. The computer system may comprise a processor for executing the computer-executable instructions, one or more electronic databases containing the data or information described herein, an input/output interface or user interface, and a set of instructions (e.g. software) for carrying out the method. The computer system can include a stand-alone computer, such as a desktop computer, a portable computer, such as a tablet, laptop, PDA, or smartphone, or a set of computers connected through a network including a client-server configuration and one or more database servers. The network may use any suitable network protocol, including IP, UDP, or ICMP, and may be any suitable wired or wireless network including any local area network, wide area network, Internet network, telecommunications network, Wi-Fi enabled network, or Bluetooth enabled network. In one embodiment, the computer system comprises a central computer connected to the internet that has the computer-executable instructions stored in memory that is operably connected to an internal electronic database. The central computer may perform the computer-implemented method based on input and commands received from remote computers through the internet. The central computer may effectively serve as a server and the remote computers may serve as client computers such that the server-client relationship is established, and the client computers issue queries or receive output from the server over a network. The queries may be an address of a target structure or geospatial coordinates of a target structure and may cause the server to calculate a location of a sensing device according to computer-executable instructions stored in memory.

The input/output interfaces may include a graphical user interface (GUI) which may be used in conjunction with the computer-executable code and electronic databases. The graphical user interface may allow a user to perform these tasks through the use of text fields, check boxes, pull-downs, command buttons, and the like. A skilled artisan will appreciate how such graphical features may be implemented for performing the tasks of this disclosure. The user interface may optionally be accessible through a computer connected to the internet. In one embodiment, the user interface is accessible by typing in an internet address through an industry standard web browser and logging into a web page. The user interface may then be operated through a remote computer (client computer) accessing the web page and transmitting queries or receiving output from a server through a network connection.

Such graphical controls and components are reusable class files that are delivered with a programming language. For example, pull-down menus may be implemented in an object-oriented programming language wherein the menu and its options can be defined with program code. Further, some programming languages integrated development environments (IDEs) provide for a menu designer, a graphical tool that allows programmers to develop their own menus and menu options. The menu designers provide a series of statements behind the scenes that a programmer could have created on their own. The menu options may then be associated with an event handler code that ties the option to specific functions. Text fields, check boxes, and command buttons may be implemented similarly through the use of code or graphical tools. A skilled artisan can appreciate that the design of such graphical controls and components is routine in the art.

The sensing device may communicate by wired or wireless communication. In one aspect, the sensing device can communicate to a network and may communicate to the internet, to the cloud, to a computing device, to a mobile computing device, to a security station, or to a central information hub. The alert system can utilize ege computing. The alert system can utilize cloud computing.

In certain embodiments, the sensing device may have a sloped or an angled edge. The sensing device can be housed within a sloped and/or transparent enclosure which allows for affixing to a glass or plastic surface, such as those described herein. For example, in one embodiment, an edge of the enclosure can be angled to meet the surface to which it is affixed. The side of the enclosure, the entire enclosure, or any portion of the enclosure, can be transparent or translucent. The sensing device can be contained within a raised area surrounded by a flat adhesive border in a round, rectangular, square, triangular, etc. shape. A window squeegee would then be able to easily move over the sensing device without hindrance or causing the sensing device to become dislodged. By way of example, the sensing device, or the container or enclosure of the sensing device, may comprise a sloped surface. Accordingly, the sensing device may be at or comprise a sloped angle where the sensing device meets the transparent or translucent covering or surface or an intermediate member between it and a transparent or translucent covering or surface.

In a preferred embodiment, the sensing device can communicate an alert, which can be audible, visual or silent. In some aspects, the alert system can cause an alarm to sound and/or a light to flash. The alert system can voice a word or words. The alert system can call the police or other emergency/first responder service provider. The alert system can call a security person. The alert system can communicate if a sensing device needs to be replaced or if a sensing device is failing or is expected to fail. The alert system can periodically test a sensing device. The alert system can identify the precise location of a sensing device and/or communicate the location of the sensing device to, for example, the police or security personnel.

Embodiments of the invention include methods comprising: placing one or more sensing device on a transparent or translucent covering or surface; wherein the one or more sensing device is placed external to the environment which is to be monitored by said one or more sensing device; communicating an alert or alarm to one or more remote electronic device from the one or more sensing device; communicating the alert or alarm from the one or more remote electronic device to one or more security, police, or other first responder source. A remote electronic device may include, but is not limited to, a computer, laptop computer, desktop computer, phone, smartphone, cellular phone, tablet, tablet computer, alarm, siren, bell, buzzer, mechanism for creating sound or light, phone system, cellular phone system, walkie-talkie system, CB radio, television, television system, radio system, augmented reality system, and/or communication system. In the event of a triggered alert or alarm, the system, in embodiments, will communicate with one or more remote electronic device(s). Any sensing device and/or sensor device and/or sensor can be used with the method embodiments of the invention, especially the inventive alert systems described herein. Such methods can include wherein the one or more sensing device comprises one or more sensor chosen from one or more of an accelerometer, micro-gyroscope, motion sensor, geo-location sensor, temperature sensor, UV sensor, radiation sensor, acoustic sensor, IR sensor, vibration sensor, or gas sensor. Such methods can include wherein the one or more sensing device is configured to distinguish a real alert from a false alert by comparing one or more stimuli sensed by the one or more sensor with one or more stimuli known to be associated with a real alert or a false alert. For example, such false alerts can be identified when a first sensing device is triggered and one or more second sensing device located within a predetermined distance from the first triggered sensing device is not triggered.

BRIEF DESCRIPTION OF THE DRAWINGS

The accompanying drawings illustrate certain aspects of some of the embodiments of the present invention, and should not be used to limit or define the invention. Together with the written description the drawings serve to explain certain principles of the invention.

DETAILED DESCRIPTION

Figure 1:
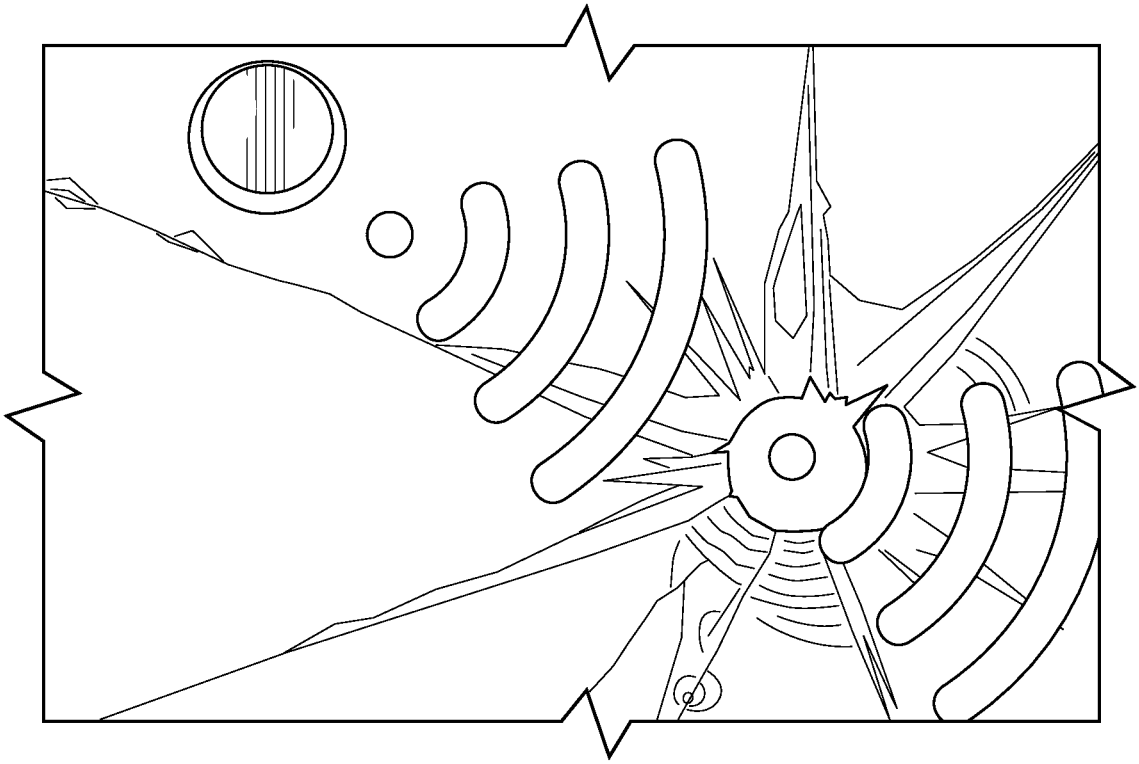
FIG. 1 is an illustration, which shows an example of the claimed device on or near a broken window that would cause an alarm to be activated. In one aspect, the sensing device would alert a security station along with information about the location of the device, such as a window number, a floor number, a room number, or other identifying or location information.

The present invention is described with reference to particular embodiments having various features. It will be apparent to those skilled in the art that various modifications and variations can be made in the practice of the present invention without departing from the scope or spirit of the invention. One skilled in the art will recognize that these features may be used singularly or in any combination based on the requirements and specifications of a given application or design. One skilled in the art will recognize that the systems and devices of embodiments of the invention can be used with any of the methods of the invention and that any methods of the invention can be performed using any of the systems and devices of the invention. Embodiments comprising various features may also consist of or consist essentially of those various features. Other embodiments of the invention will be apparent to those skilled in the art from consideration of the specification and practice of the invention. The description of the invention provided is merely exemplary in nature and, thus, variations that do not depart from the essence of the invention are intended to be within the scope of the invention.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

The invention disclosed herein is that of an alert system having a sensing device, whereby the sensing device is affixed directly or indirectly to a transparent or translucent covering or surface, such as a window or other glass or see-through substrate. (When the word "glass" is used herein, it is meant to cover any transparent or translucent covering or surface which can be by way of example only: glass, plastic, or a combination thereof) The sensing device may be affixed directly or indirectly to the outside surface of such covering, which may be exposed to the outdoor environment, and whereby the sensing device can be connected either by wire or wirelessly to a computer device. In one embodiment, the alert system comprises a plurality of sensing devices remote from one another. The alert system tracks the activity each of the sensing device in such a system of connected or related sensing devices. In one aspect, one or more computer devices monitor the alert system. In one embodiment, a single mobile computing device monitors the alert system, although multiple computer devices can monitor the alert system, including multiple mobile computing devices. In a preferred embodiment, the alert system is capable of locating each of sensing device and/or tracking the status of each sensing device in a system of sensing devices.

The transparent or translucent covering or surface can be one or more of glass or plastic window walls, fixed or movable plate glass or plastic panel(s), sliding glass or plastic door(s), partial or full glass or plastic ceilings and floors, window(s), window pane(s), skylight(s) or door(s). Such transparent or translucent covering or surface can be made of a single pane or multiple panes. Such transparent or translucent covering or surface can be, by way of example only, multi-paned and with gas between the panes. These multi-paned windows or other types of multi-paned transparent or translucent coverings or surfaces are used to improve the loss thermal heat or cooling from the room or space within the structure to which these coverings are affixed. The space between the panes of a multi-paned transparent or translucent covering or surface are, in some aspects, filled with an inert gas, by way of example only: argon, krypton, and/or xenon gas. In one aspect, the alert system described herein distinguishes a false alert from a real alert when an external pane of glass or plastic is broken before that of an internal pane of glass or plastic.

In a preferred embodiment, the sensing device comprises at least one sensor. The sensing device may be self-contained, such that it can be operated independently, having its own sensor(s), power source, and/or communication capability. The sensing device may also be dependent or reliant on other components; for example, in one aspect, it is wired to a power source and/or a communication system and thus not self-contained.

In a preferred embodiment, the inventive device is connected to and/or part of a communication network whereby an alert can be communicated to other sensing devices, emergency/security personnel, a user of the system or device, a computer, a security center, a remote device, or other central information hub, if the sensing device is triggered, such as, for example, if a window on which the sensing device is located and/or affixed or placed is broken. Such a trigger comprises, for example, a broken, tampered, manipulated, cut, or otherwise violated window, window pane(s), skylight, or door. A trigger may comprise violation of a preset level of a vibration of a window, window pane(s), skylight or door. Such violation can be that of a preset level of a sound located at a window, window pane(s), skylight or door; accordingly, in one embodiment, the sensing device comprises a microphone. In aspects, an acoustic sensor or microphone is set, programmed, and/or configured such that an alarm or alert is not triggered in response to certain types of sounds such as, by way of example only, thunder, wind, rain, hail, music, other weather events, or other noise that is not an indication that an alarm or alert should be triggered.

In one aspect, communication from the sensing device is directed to the room or space in which the window is contained and whereby a warning, such as a visual or auditory warning, is issued to anyone in this room or space. Communication from the sensing device can also be directed to the room or space adjacent to the room or space in which the transparent or translucent covering is contained and whereby a warning is issued to anyone in this room or space. In another aspect, communication from the sensing device is directed to a security station or security personnel within the building in which the window, window pane(s), skylight or door is contained. Communication from the sensing device can also be directed to a remote security station of, by way of example only, a private or public police or security office. The sensing device can be connected by a wired connection to a network. The sensing device can also be connected by a wireless connection to a network. The sensing device can be connected to the internet and/or to the cloud.

In one embodiment, the sensing device when triggered causes a light associated with the sensor device to become activated. The light can be an LED or an OLED light. The sensing device can when triggered cause an auditory or other visual alarm associated with the sensor device to become activated. The alarm can be a sound or a voice alarm. The sensing device can when triggered cause a communication associated with the sensor device to become activated. The sensing device can when triggered cause an alert associated with the sensor device to become activated. The sensing device when triggered can cause a light or lights within the room or space in which the window, window pane, skylight or door is located to be activated. The light or lights can be activated such that they turn on constantly, such as for a fixed period of time or indefinitely. The light or lights can be activated such that they blink. The triggered sensing device can communicate wirelessly to a mobile computing device. The triggered sensing device can communicate wirelessly to, by way of example only, a computer, a laptop, a tablet computing device, a smart phone, an augmented reality system, a mixed reality system, and/or an artificial intelligence or machine learning system. The sensing device may also implement artificial intelligence and/or machine learning or be part of an artificial intelligence and/or machine learning system. For example, the sensing devices, in one aspect, can use artificial intelligence and/or machine learning to learn to ignore certain environmental noise or sounds while actively monitoring the transparent or translucent covering(s) or surface(s) so to reduce false alarms. The sensing device can also reduce false positive triggers, by way of example, by noting when multiple sensing devices would be triggered vs. when only a single sensing device would be triggered. In one aspect, over time, the device or system will learn to differentiate between genuine and false events.

Unlike prior art alarm sensing devices, the sensing device as taught herein is placed (in most embodiments) on the "outside" or "outdoor" side of a window, window pane(s), skylight or door. This is the side of the window, window pane(s), skylight or door which is, in most cases, opposite the inside of the room or space to which it is connected or located. For clarity, this is typically the outdoor side of the window, window pane(s), skylight or door that is exposed to the outside environment. However, in certain embodiments the sensing devices can be placed on the outside side exposed to the outdoor elements of the building side or the frame which houses or supports the transparent or translucent covering. In embodiments, the sensing devices can be placed near or adjacent to the transparent or translucent covering which the sensing device(s) is monitoring. In still other embodiments, the sensing device(s) can be placed on the outside side of transparent or translucent covering which is exposed to the outdoor elements and also on the outside side of the building or the frame which houses or supports the transparent or translucent covering which is exposed to the outdoor elements, but near the transparent or translucent covering which the sensing device(s) is monitoring. Unlike prior art alarm sensing devices, the sensing device as taught herein is for keeping an individual or individuals "inside" a room or space, as opposed to, for example, a burglar alarm sensor that is used for keeping an individual or individuals from getting inside (meaning remaining outside) of a room or space. The sensing device taught herein is also to alert a system, people, or authorities if a person has broken or tampered with a window or door; for example, if a person has broken a window or door to gain access to the outside space.

In certain embodiments, the sensing device can be embedded within the glass or plastic of a window, window pane(s), skylight or door. In other embodiments, the sensing device can be attached to the outside (outdoor) surface of the glass or plastic of the window, window pane(s), skylight or door. In other embodiments, the sensing device can be attached to the "indoor" or "inside" surface of a glass or plastic of the window, window pane(s), skylight or door. When added to the "indoor" or "inside" surface of the window, window pane(s), skylight or door, the sensing device may be housed within a tamper proof housing such that if it is tampered with the sensor will cause an alarm to sound and will communicate with a security station. In the various embodiments, whereby the sensing device is attached to either the inside side or outside side of a window, window pane(s), skylight or door, the sensing device can be directly or indirectly applied to the surface of the window, window pane, skylight or door. One or more sensing devices can be applied to the surface (indoor, outdoor, or embedded) of the window, window pane(s), skylight or door.

In aspects, the sensing device comprises its own power source, such as a battery, rechargeable battery, capacitor, supercapacitor, utlracapacitor, solar cell(s), energy harvesting unit/system, remote solar cell, photovoltaic cell, and/or remote energy harvesting system. In certain embodiments, the sensing device includes a controller, microcontroller, an ASIK, an accelerometer, an acoustic sensor, such as a microphone, a motion sensor, a geo-location sensor, GPS, memory storage, memory, a source of illumination, an LED, and OLED, a light, a heat sensor, a temperature sensor, thermal sensor, a vibration sensor, a gas sensor, an inert gas sensor, an argon gas sensor, a krypton gas sensor, a xenon gas sensor, a pressure sensor, a transceiver, a transmitter, a receiver, and/or a communication chip (wireless or wired communication). The sensing device can communicate by radio frequency, Wifi, Bluetooth, and/or wireless communication. The sensing device can include a speaker, a buzzer, a ringer, a microphone, a switch, a radioactive sensor, a UV sensor, and/or an IR sensor. The sensing device can include a clock or timer. The sensing device can include a time and date stamp. In aspects, the sensing devices may comprise one or more of a light source, a light emitting component, a sound emitting component, an LED light, an OLED light, a buzzer, and/or a bell.

In one aspect, the sensing device is housed within a sealed enclosure. The sensing device can be housed within a partly or wholly transparent, translucent, or opaque enclosure. The enclosure can have one or more transparent parts. The enclosure can have one or more transparent sides. One side of the enclosure can be affixed to a surface of a window, window pane(s), skylight or door. The manner in which the enclosure can be affixed can be with an adhesive, a mechanical attachment, a structural attachment, and/or a chemical bond. The enclosure can have a sloping surface or an angled surface. In certain embodiments, electronic components of the sensing device can be offloaded and incorporated within the enclosure housing or enclosure covering.

The sensing device can be affixed to a surface of a window, window pane(s), skylight and door by way of an adhesive, a mechanical attachment, a structure attachment, and/or a chemical bond.

In one embodiment, an outer edge of either the sensing device, the cover of the sensing device, or the enclosure that houses or covers the sensing device, is angled or sloped to meet the glass or plastic surface to which it is affixed. This would allow for a window washer, for example, to pull a squeegee over the window without dislodging the sensing device.

In a preferred embodiment, the alert system as taught herein is able to eliminate or substantially reduce false alerts. These false alerts could occur due to, by way of example only, a thunderstorm, high wind, earthquake, sonic boom of a jet, nearby construction, concert event, or other noise, vibration, or impact that is not indicative of requiring the alarm to be triggered. The alert system, which in embodiments comprises a plurality of sensors distanced from one another, is able to distinguish a false alert when one or more sensors located within a predetermined distance from a triggered sensor are not triggered. The alert system can distinguish a false alert when three or more sensors located within a predetermined distance from a triggered sensor are not triggered. The alert system can distinguish a false alert when four or more sensors located within a predetermined distance from a triggered sensor are not triggered. The alert system can distinguish a false alert when five or more sensors located within a predetermined distance from a triggered sensor are not triggered. The alert system can distinguish a false alert when six or more sensors located within a predetermined distance from a triggered sensor are not triggered. The alert system can distinguish a false alert when seven or more sensors located within a predetermined distance from a triggered sensor are not triggered. The alert system can distinguish a false alert when eight or more sensors located within a predetermined distance from a triggered sensor are not triggered. The alert system can distinguish a false alert when nine or more sensors located within a predetermined distance from a triggered sensor are not triggered. The alert system can distinguish a false alert when ten or more sensors located within a predetermined distance from a triggered sensor are not triggered.

The alert system, which in embodiments comprises a plurality of sensors distanced from one another, is able to distinguish a real alert when one or more sensors located within a predetermined distance from a triggered sensor are not triggered.

In embodiments, the alert system can also distinguish a false alert from that of a real alert when an inert gas sensor does not sense an inert gas. The alert system can distinguish a false alert from that of a real alert when an argon gas sensor does not sense argon gas. The alert system can distinguish a false alert from that of a real alert when a krypton gas sensor does not sense krypton gas. Alternatively, in one embodiment, the alert system is triggered or not triggered if a gas is sensed or not sensed. For example, in certain embodiments, an alert is triggered if a certain gas is sensed. In another example, an alert is triggered if a certain gas is not sensed, which may occur if gas leaches out of space between window panes upon the windows panes being broken or punctured. In one aspect, the alert system can distinguish a false alert from that of a real alert when an external pane (closest to the outdoor environment) of a multi-pane transparent or translucent covering is broken before that of an internal pane (closest to the room or space to which it is affixed) is broken. In another aspect, the alert system can distinguish a false alert from that of a real alert when an external pane (closest to the outdoor environment) of a multi-pane transparent or translucent covering is broken after that of an internal pane (closest to the room or space to which it is affixed) is broken.

In certain other embodiments, a temperature sensor (thermal sensor) incorporated within or connected to the sensing device can sense a temperature differential causing a spike differential of the temperature of the transparent or translucent covering which is being monitored. By way of example only, during the summer time a broken window will allow cool indoor air to be leaked to the outdoors thus the sensing device can recognize that temperature differential which will show up as a temperature spike to the downside from that of the outdoor air temperature. However, during the winter time a broken window will allow warm indoor air to be leaked to the outdoors thus the sensing device can recognize that temperature differential which will show up as a temperature spike to the upside from that of the outdoor air temperature. Accordingly, in one embodiment, an alarm may be triggered if a sensing device senses that a temperature differential, or temperature change, indicates, for example, a window has been broken.

The alert system can comprise a sensing device which is located on the outside side of a transparent or translucent covering which is exposed to the outdoor environment, the sensing device can comprise a thermal sensor. The thermal sensor can monitor for a preset spike temperature differential (up or down) within a preset period of time and should such a spike differential occur trigger an alert from the sensing device. By way of example only, should the thermal sensor of the sensing device monitor a temperature spike differential of 5 degrees fahrenheit within 1 second of time the sensing device will trigger an alert. Should the thermal sensor of the sensing device monitor a temperature spike differential of 10 degrees fahrenheit within 2 seconds of time the sensing device will trigger an alert. Should the thermal sensor of the sensing device monitor a temperature spike differential of 10 degrees fahrenheit within 5 seconds of time the sensing device will trigger an alert. In certain cases the alert system will compare the sensing device's sensing of such a temperature spike differential to that of other distance separated sensing devices which are monitoring other distance separated transparent or translucent coverings. Should such other distance separated sensing devices report the same temperature spike differential within the same time period the alert system will determine the alert was a false alert. However, should such other distance separated sensing devices report no temperature spike differential the alert system will determine the alert was a real alert.

In embodiments, combinations of stimuli can be sensed and used to determine if an alarm should be triggered in response to the stimuli. For example, one or more sensors could detect vibrations and sounds and certain combinations of various vibrations and sounds could be used to trigger an alarm. Any one or more of the stimuli (e.g., sound, vibration, temperature, humidity, pressure, etc.) can be combined in this manner and analyzed with an algorithm to determine whether a stimulus or stimuli and/or the intensity of the stimulus or stimuli indicate(s) a real or fake alarm situation. For example, such sensing devices can be configured to distinguish a glass bottle being broken against the side of a building as a false alarm, where the sound of the glass bottle shattering might trigger a sound sensor but might not trigger a vibration sensor.

It should be understood that in most, but not all cases, a combination of multiple different types of sensors located within multiple distanced separated sensing devices are utilized to determine if a break or fracture of the transparent or translucent covering has occurred before triggering an alert. Such sensing can be accomplished almost instantaneously due to the manner in which the plurality of sensing devices are networked together. In certain cases, one common type sensor located within multiple distanced separated sensing devices is utilized to determine if a break or fracture of the transparent or translucent covering has occurred before triggering an alarm. Such a plurality of sensing can be accomplished almost instantaneously due to the manner in which the plurality of sensing devices are networked together.

For clarity, the sensing device can be affixed to the outside side exposed to the outdoor environment of any covered opening of an interior room or space such as, by way of example only, glass window walls, fixed or movable plate glass panel(s), sliding glass door(s), partial or full glass ceilings and floors, window(s), window pane(s), skylight(s) or door(s). For clarity, the sensing device can be affixed on the outside side exposed to the outdoor environment of a building or the frame which houses or supports the transparent or translucent covering such as, by way of example only, glass window walls, fixed or movable plate glass panel(s), sliding glass door(s), partial or full glass ceilings and floors, window(s), window pane(s), skylight(s) or door(s). For clarity, the enclosure housing the sensing device can be affixed to any covered opening of an interior room or space to the outside environment such as, by way of example only, glass window walls, fixed or movable plate glass panel(s), sliding glass door(s), partial or full glass ceilings and floors, window(s), window pane(s), skylight(s) or door(s). For clarity, the cover of a sensing device can be affixed to any covered opening of an interior room or space to the outside environment such as, by way of example only, glass window walls, fixed or movable plate glass panel(s), sliding glass door(s), partial or full glass ceilings and floors, window(s), window pane(s), skylight(s) or door(s). For clarity, the enclosure of the sensing device can be affixed to any covered opening of an interior room or space to the outside environment such as, by way of example only, glass window walls, fixed or movable plate glass panel(s), sliding glass door(s), partial or full glass ceilings and floors, window(s), window pane(s), skylight(s) or door(s).

In embodiments, a triggered sensing device communicates wirelessly to a mobile computer device or central processing hub. The mobile computer device can be a computer, laptop, tablet, smart phone, augmented reality device, mixed reality device, walkie talkie, or any other computing or communication device. In embodiments, a triggered sensing device communicates wirelessly to a network, the internet, and/or the cloud. A triggered sensing device can communicate in a wired manner to a network, the internet, or the cloud.

Figure 2:
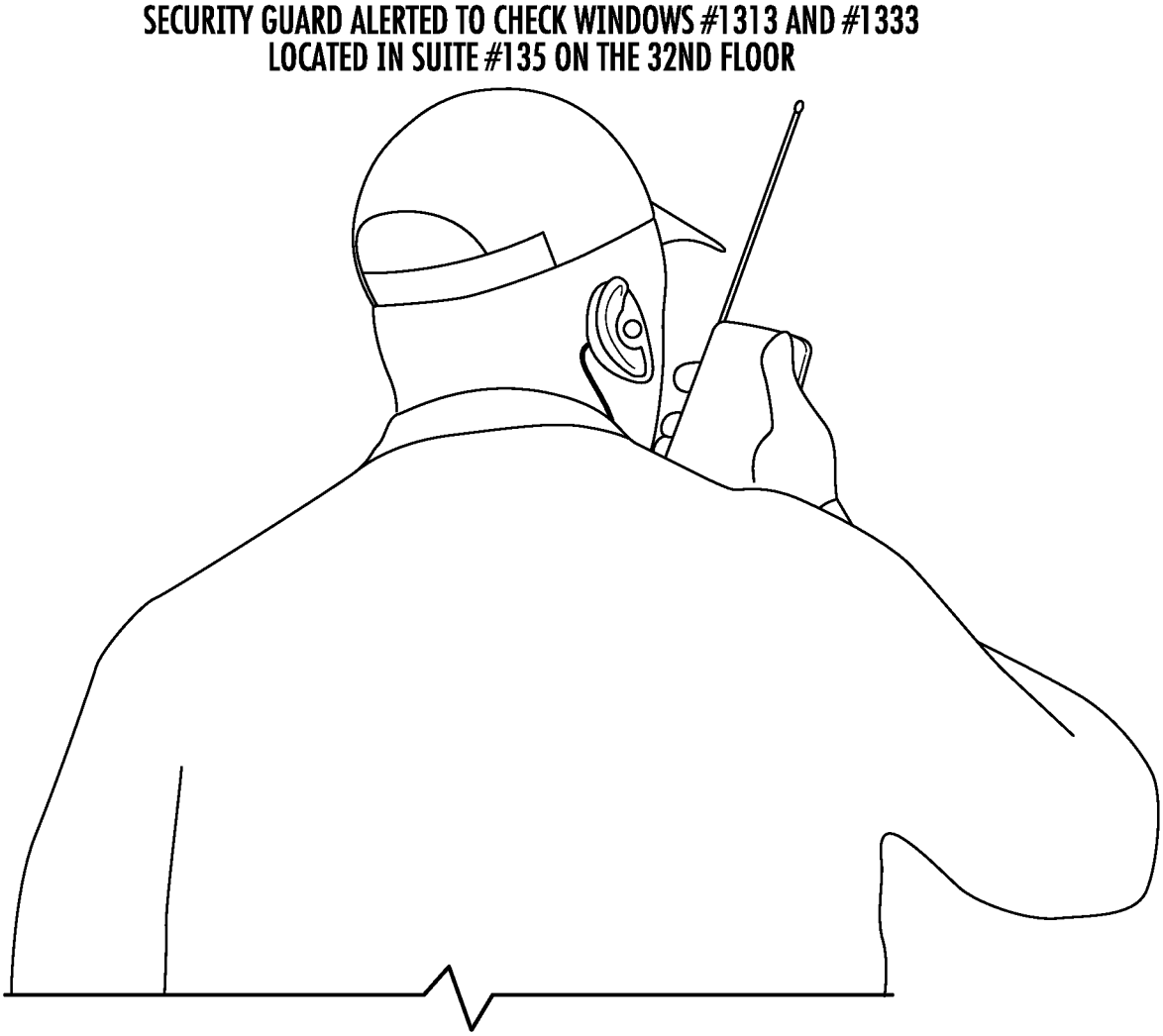
FIG. 2 is an illustration, which shows a possible result of a sensing device(s) according to the present invention being triggered.
Figure 3:
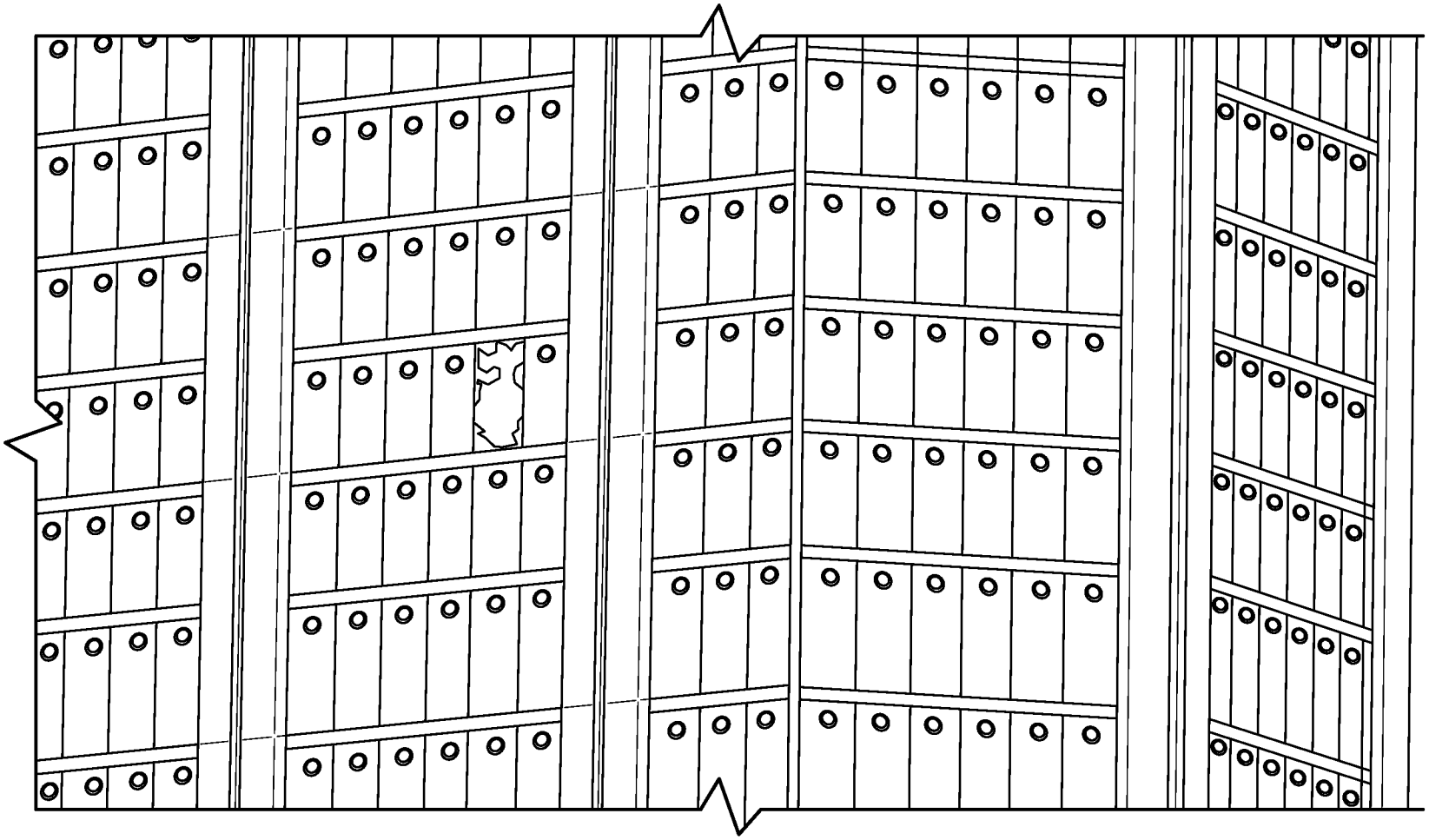
FIG. 3 is an illustration, which shows an example of the claimed devices installed on windows of a premises.

Turning now to the figures, FIG. 1 shows a sensing device on a window and indicates that an alarm or alert would be triggered if the window on which it was placed was broken or otherwise comprised, tampered with, or violated. FIG. 2 shows an example of what might happen if a window with a sensing device as taught herein was violated and the sensing device triggered. In one embodiment, security and/or police or other first responder personnel would be contacted and given information about the location of the alert/alarm, such as the address, building, floor, room or unit number, or other information that would indicate where the sensing device was triggered so the security or other personnel could further investigate. FIG. 3 represents an embodiment in which several sensing devices are located on windows in a building. Such sensing devices may be independent or connected to alert or alarm relevant authorities, or to avoid false positive triggering, as described herein.

Figure 4:
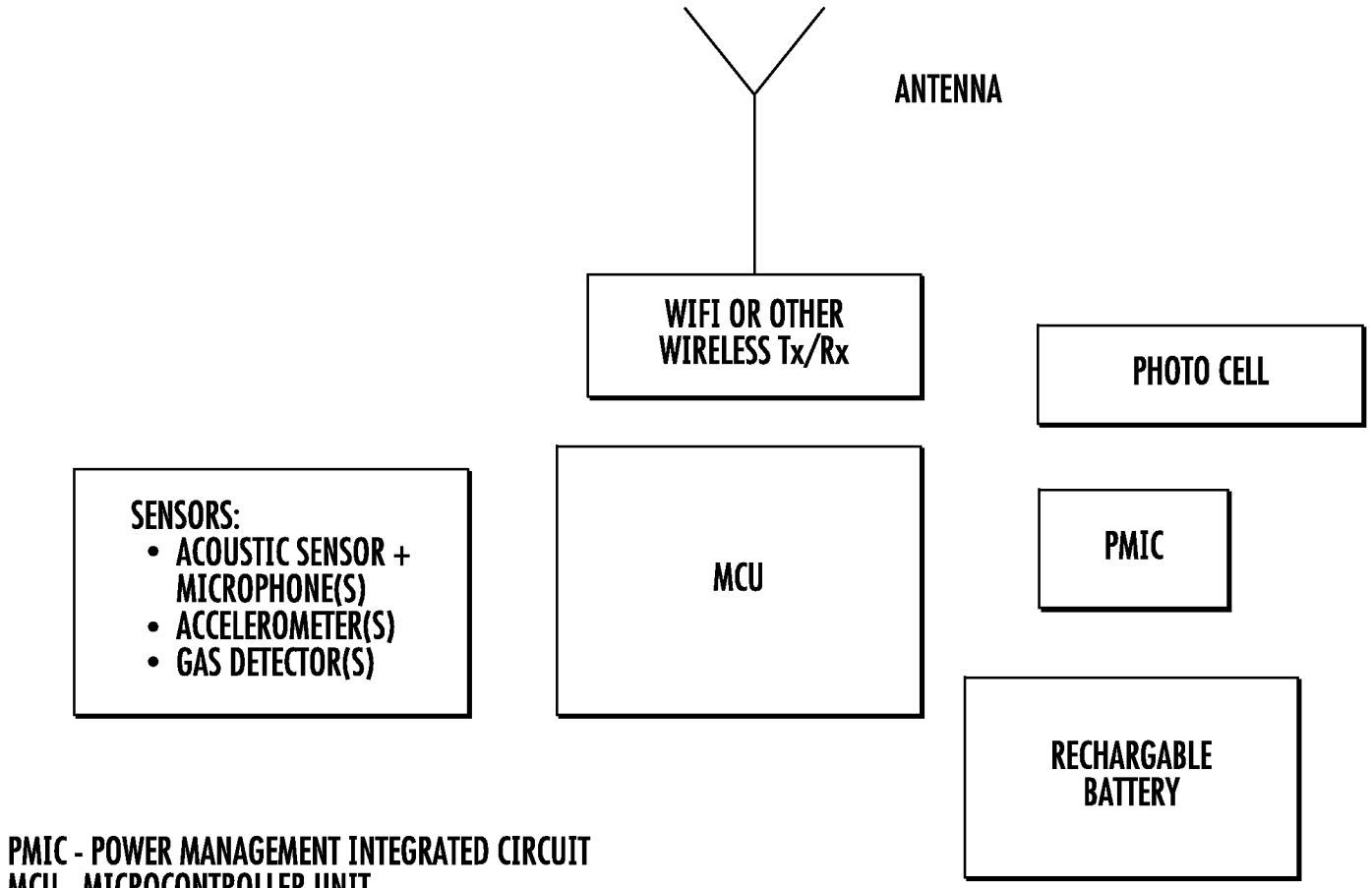
FIG. 4 is a diagram, which shows an embodiment of a sensing device according to the present invention.

FIG. 4 shows a possible embodiment of a sensing device as described herein. In this particular embodiment, the sensing device comprises an antenna that allows the sensing device to connect to other sensing devices or other electronic devices wirelessly, such as by way of WiFi or other transmitter/receiver-based wireless communication. This embodiment comprises a rechargeable battery. The embodiment comprises a solar cell, which allows for the harvesting of solar power to recharge the rechargeable battery of the sensing device or to partially or fully power the sensing device. The embodiment comprises a power management integrated system, which allows for efficient power management of the sensing device. The embodiment comprises a microcontroller unit, which allows for controlling the functionality of the sensing device. In this particular embodiment, the sensor comprises one or more of an acoustic sensor, such as one or more microphones or vibration detectors(s), an accelerometer, and/or a gas detector.

Figure 5:
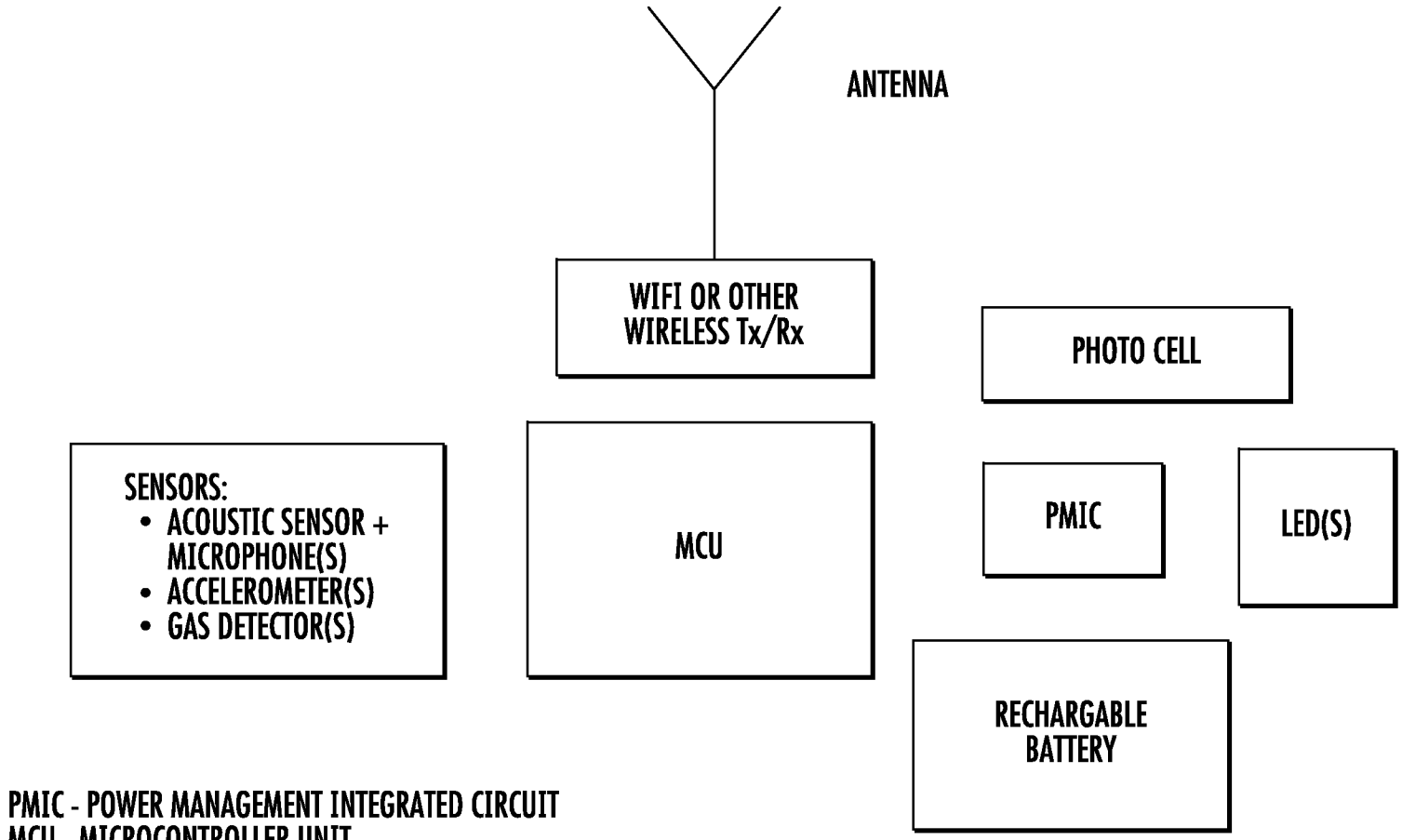
FIG. 5 is a diagram, which shows an embodiment of a sensing device according to the present invention.

FIG. 5 shows a possible embodiment of a sensing device as described herein. In this particular embodiment, the sensing device comprises a light source in addition to the components of FIG. 4. For example, the sensing device may comprise an LED or OLED light to alert by way of visual cue the triggering of the alarm/alert or other functions of the device, including whether the battery is running low, whether another sensing device has been triggered, or other reason for a visual alert, cue, indication, or alarm.

Figure 6:
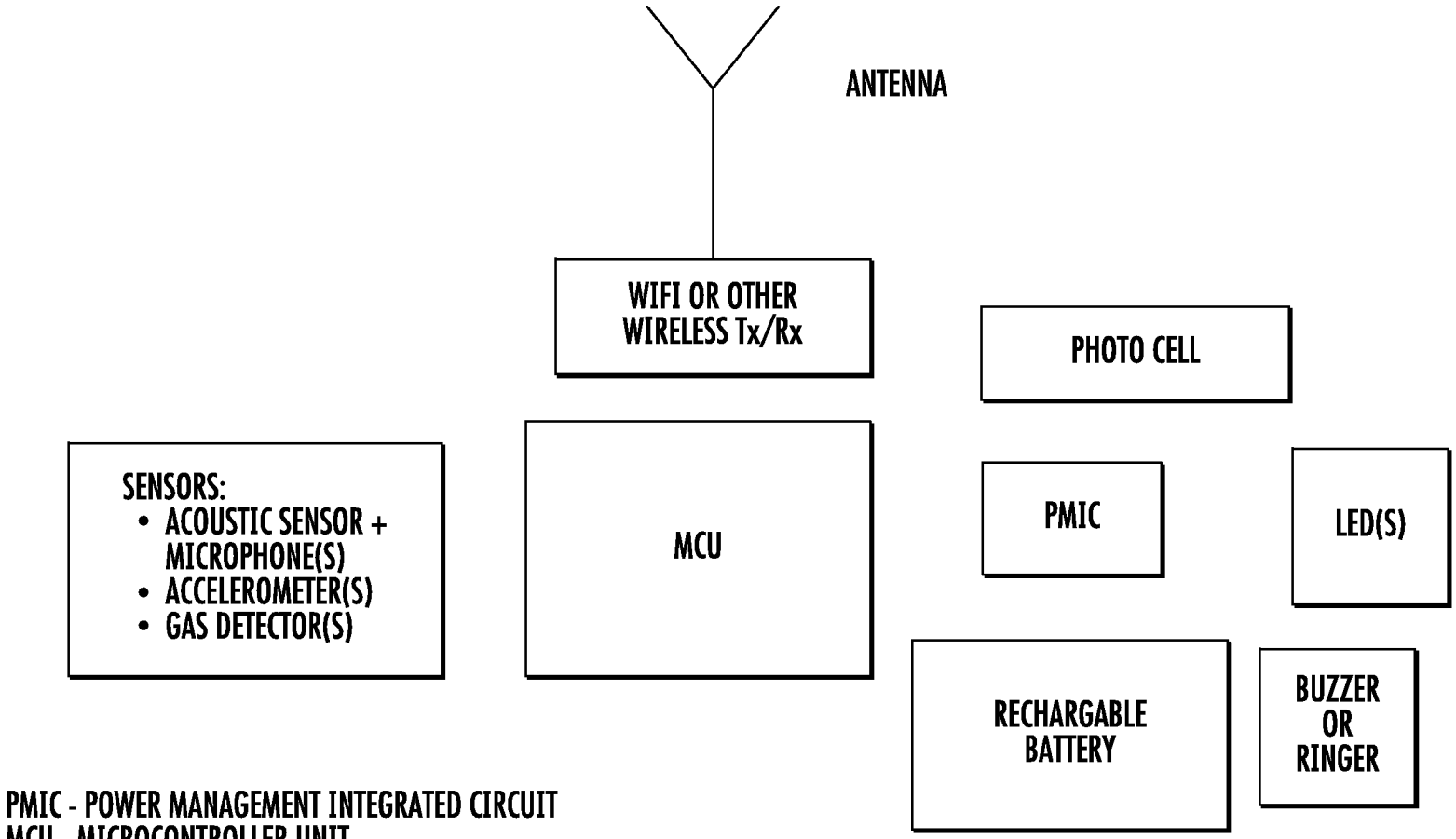
FIG. 6 is a diagram, which shows an embodiment of a sensing device according to the present invention.

FIG. 6 shows a possible embodiment of a sensing device as described herein. In this particular embodiment, the sensing device comprises an auditory source or sound source in addition to the components of FIG. 5. For example, the sensing device may comprise a buzzer, ringer, or other sound generating mechanism to alert by way of auditory cue the triggering of the alarm or alert, or other functions of the device, including whether the battery is running low, whether another sensing device has been triggered, or other reason for an auditory alert, cue, indication, or alarm.

Figure 7:
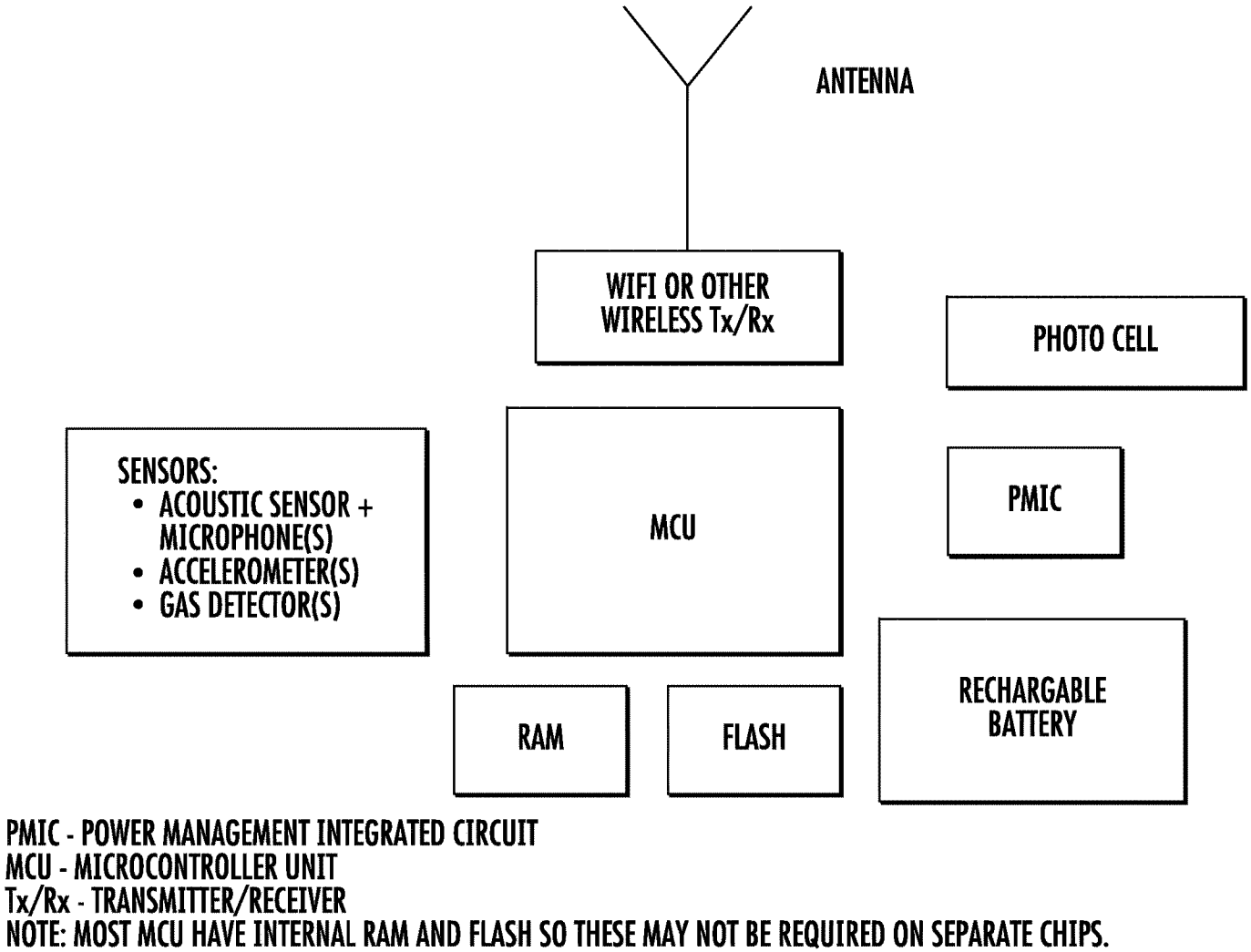
FIG. 7 is a diagram, which shows an embodiment of a sensing device according to the present invention.
Figure 8:
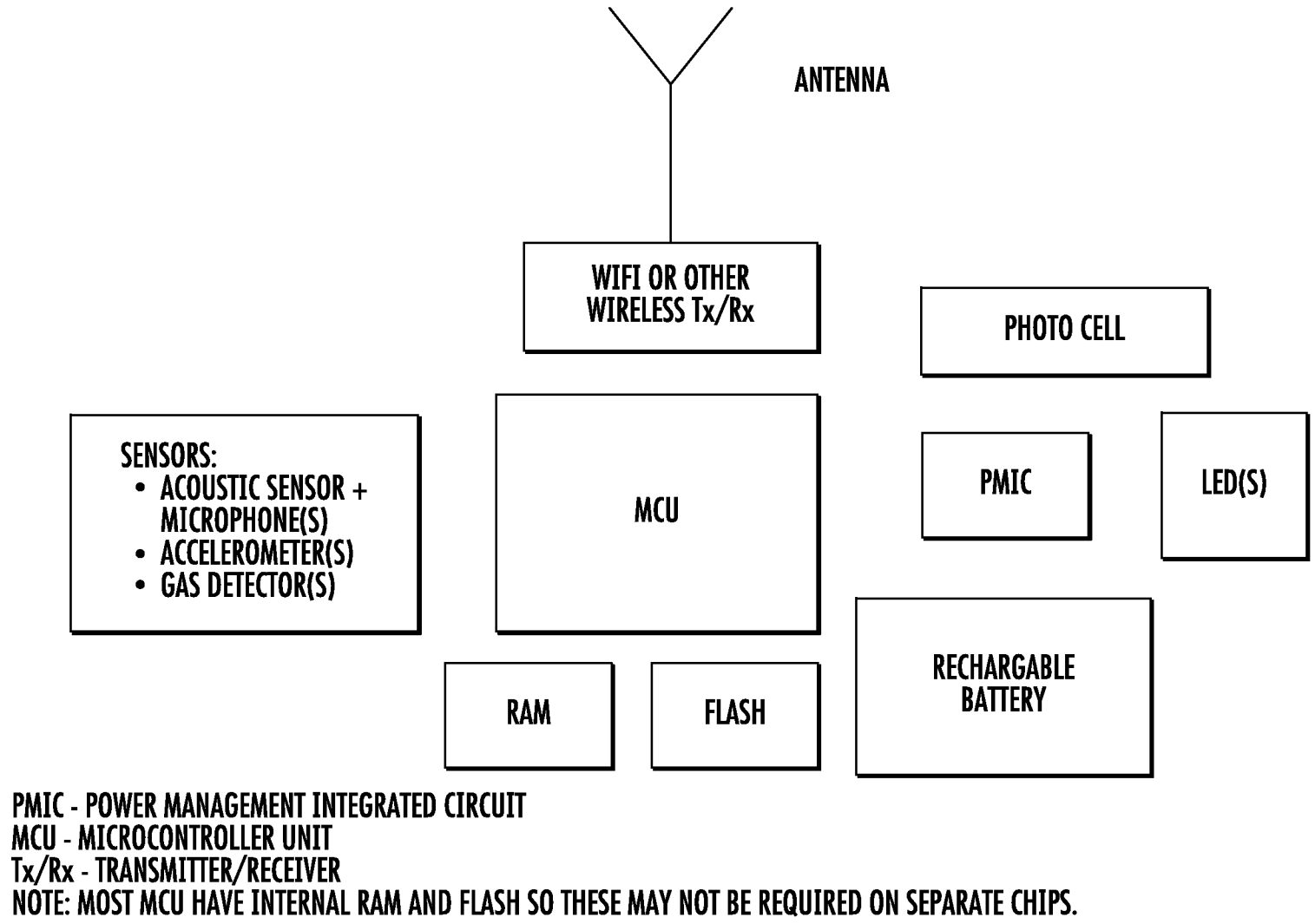
FIG. 8 is a diagram, which shows an embodiment of a sensing device according to the present invention.
Figure 9:
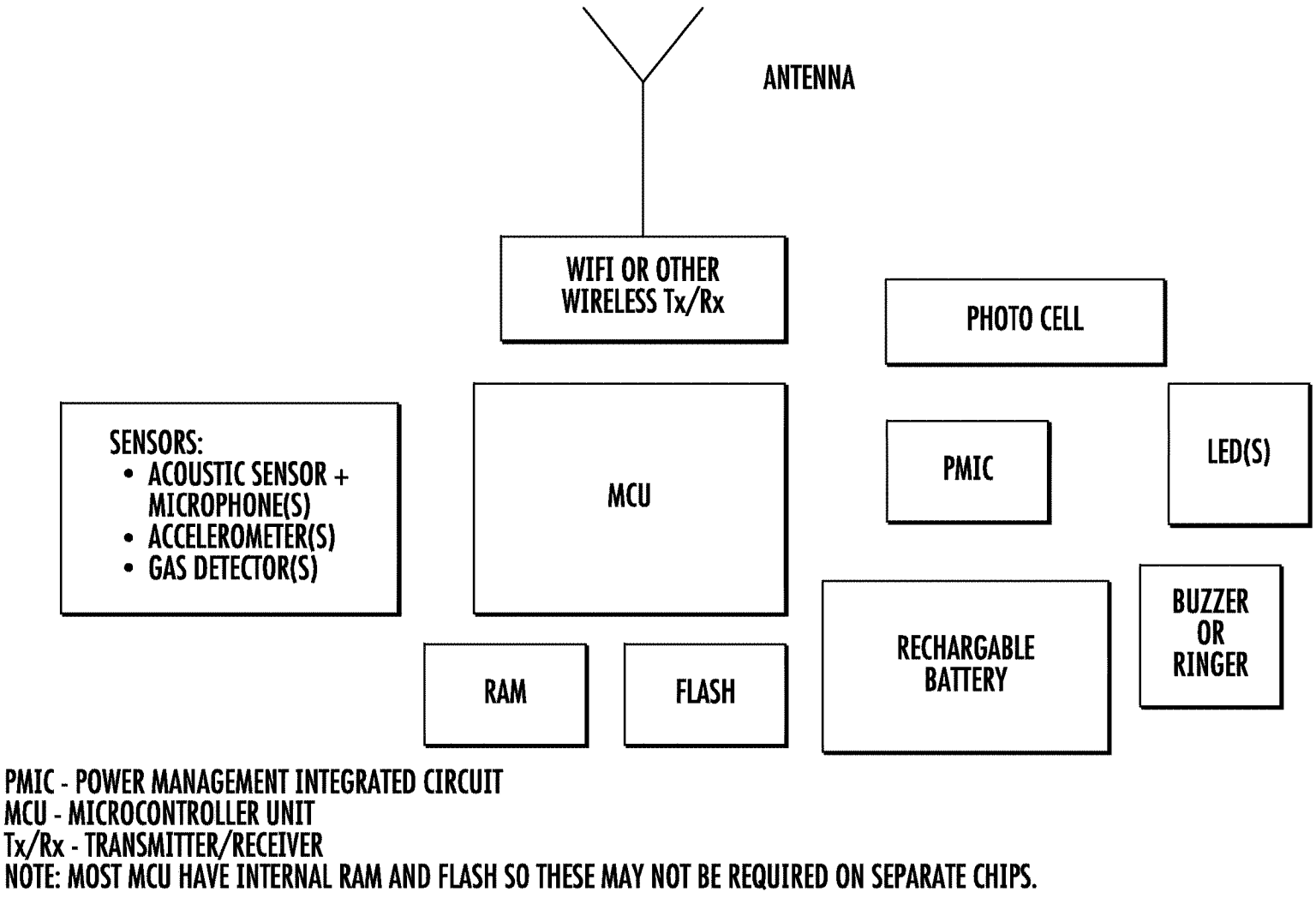
FIG. 9 is a diagram, which shows an embodiment of a sensing device according to the present invention.
Figure 10:
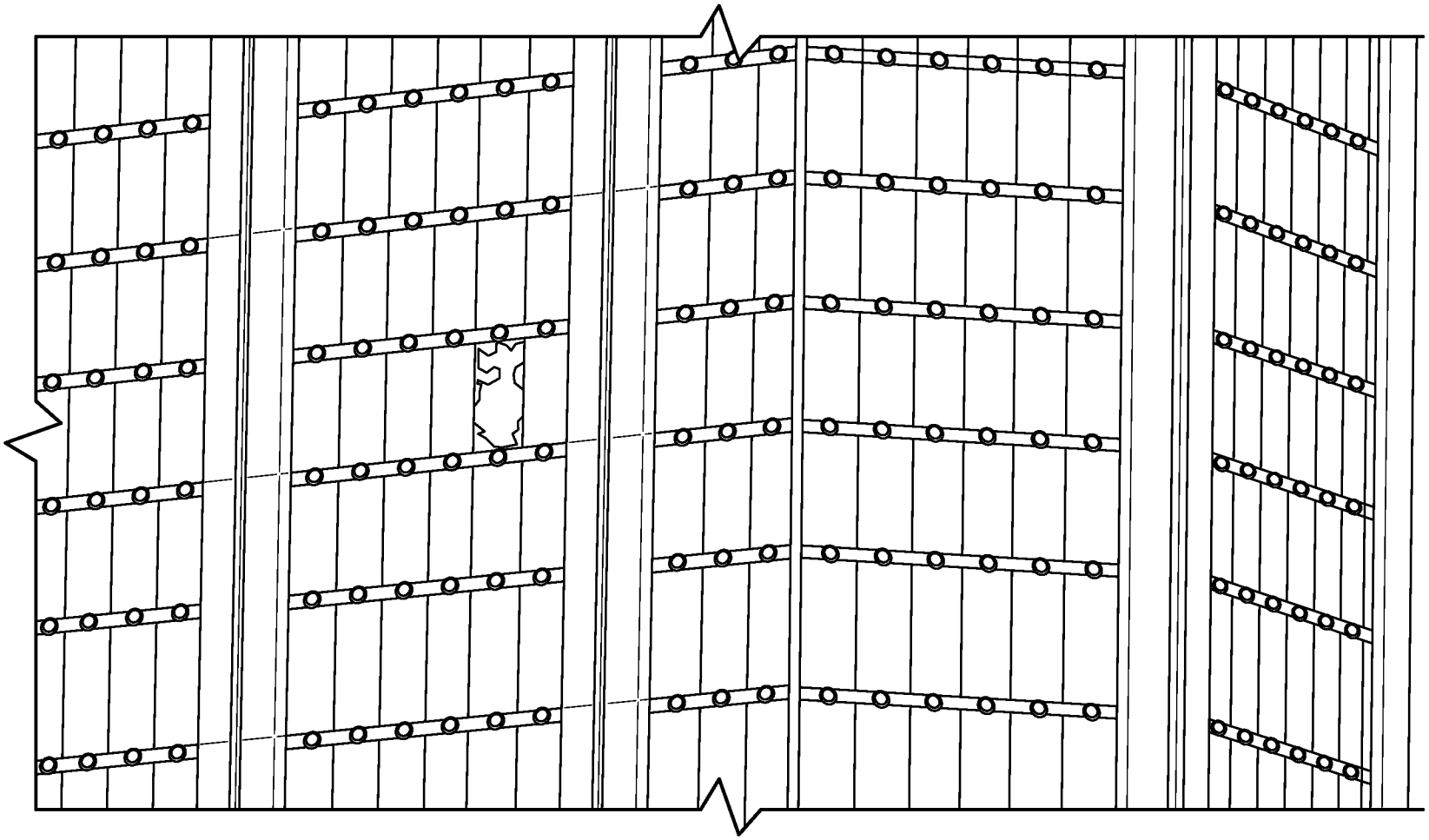
FIG. 10 is an illustration, which shows an example of the claimed devices installed near windows of a premises.

FIG. 7 shows a possible embodiment of a sensing device as described herein. In this particular embodiment, the sensing device comprises a storage and/or memory unit(s), such as, by way of example only, RAM or flash memory. Most microcontroller units have internal RAM and/or flash memory, so these may not be required on separate chips. FIG. 8 shows the sensing device of FIG. 7 but also comprising a light source. FIG. 9 shows the sensing device of FIG. 8 but also with an auditory or sound source. FIG. 10 shows an example of sensing devices near windows on a premises.

One skilled in the art will recognize that the disclosed features may be used singularly, in any combination, or omitted based on the requirements and specifications of a given application or design. When an embodiment refers to "comprising" certain features, it is to be understood that the embodiments can alternatively "consist of" or "consist essentially of" any one or more of the features. Other embodiments of the invention will be apparent to those skilled in the art from consideration of the specification and practice of the invention.

It is noted in particular that where a range of values is provided in this specification, each value between the upper and lower limits of that range is also specifically disclosed. The upper and lower limits of these smaller ranges may independently be included or excluded in the range as well. The singular forms "a," "an," and "the" include plural referents unless the context clearly dictates otherwise. It is intended that the specification and examples be considered as exemplary in nature and that variations that do not depart from the essence of the invention fall within the scope of the invention. Further, all of the references cited in this disclosure are each individually incorporated by reference herein in their entireties and as such are intended to provide an efficient way of supplementing the enabling disclosure of this invention as well as provide background detailing the level of ordinary skill in the art.

The invention claimed is:

1. An alert system comprising a plurality of distance separated sensors and a plurality of distance separated doors or windows, wherein the doors or windows each comprise two or more panes of transparent or translucent material, wherein the sensors monitor for breakage of the doors or windows, wherein the sensors are capable of allowing the alert system to determine if a pane of one or more of the doors or windows located closer to an inside environment is broken before a pane located closer to an outside environment, wherein the alert system is capable of determining a real alert or alarm if a pane of one or more of the doors or windows located closer to an inside environment is broken before a pane located closer to an outside environment, and wherein the alert system is capable of determining a false alert or alarm if the alert system determines at least two sensors of the plurality of sensors have triggered an alert or alarm simultaneously or within a set period of time.

2. The alert system of claim 1, wherein the sensors are chosen from one or more of an accelerometer, microgyroscope, motion sensor, geo-location sensor, temperature sensor, UV sensor, radiation sensor, acoustic sensor, IR sensor, vibration sensor, and/or gas sensor.

3. The alert system of claim 1, wherein one or more of the transparent or translucent coverings or surfaces is chosen from one or more of glass or plastic window walls, fixed or movable plate glass or plastic panels, sliding glass or plastic doors, partial or full glass or plastic ceilings or floors, windows, window panes, skylights, and/or doors.

4. The alert system of claim 1, wherein the sensors comprise one or more of a power source, a communication source, an enclosing structure, a controller, a transceiver, a receiver, and/or a transmitter.

5. The alert system of claim 1, wherein the alert system is triggered if only one of the transparent or translucent coverings or surfaces is broken.

6. The alert system of claim 1, wherein one or more of the sensors, if a real alert is triggered, communicate an alert or alarm to one or more electronic device.

7. The alert system of claim 1, wherein the alert system tests the status of the sensors, and/or indicates if a sensor needs to be replaced, serviced, is failing, or is expected to fail.

8. The alert system of claim 1, wherein the alert system identifies the location of the distance separated sensors.

9. The alert system of claim 1, wherein the distance separated sensors include one or more types of sensors, and wherein the sensors are located at varying distances from one another allowing the system to distinguish whether an alert from the system is a false alert or a real alert.

10. The alert system of claim 1, wherein one or more of the distance separated sensors comprises a thermal sensor, wherein the thermal sensor monitors for a temperature differential up or down within a preset period of time and should such a temperature differential occur trigger an alert from the one or more sensors the distance separated sensors.

11. The alert system of claim 1, wherein one or more of the distance separated sensors comprise a power source that utilizes energy harvesting.

12. The alert system of claim 1, wherein one or more of the distance separated sensors comprise a solar cell and/or a photovoltaic cell.

13. The alert system of claim 1, wherein one or more of the distance separated sensors comprise a timer and/or a time clock.

* * * * *